US007703758B2

(12) United States Patent
Kamiya et al.

(10) Patent No.: US 7,703,758 B2
(45) Date of Patent: Apr. 27, 2010

(54) SHEET STACKING DEVICE AND SHEET PROCESSING DEVICE, AND IMAGE FORMING APPARATUS PROVIDED THEREWITH

(75) Inventors: Daisaku Kamiya, Abiko (JP); Hideki Kushida, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 584 days.

(21) Appl. No.: 11/468,461

(22) Filed: Aug. 30, 2006

(65) Prior Publication Data

US 2007/0045924 A1 Mar. 1, 2007

(30) Foreign Application Priority Data

Aug. 31, 2005 (JP) ..... 2005-251424

(51) Int. Cl.
*B65H 37/04* (2006.01)

(52) U.S. Cl. ..... 270/58.09; 270/58.1; 270/58.08; 270/58.12; 270/58.17

(58) Field of Classification Search ..... 270/58.1, 270/58.08, 58.09, 58.12, 58.17
See application file for complete search history.

(56) References Cited

U.S. PATENT DOCUMENTS 5,590,871 A * 1/1997 Okabe et al. ..... 270/58.27
6,885,832 B2 * 4/2005 Osada ..... 399/45
6,962,331 B2 * 11/2005 Matsumoto et al. ..... 270/58.09
7,152,856 B2 12/2006 Kamiya et al. ..... 270/37
7,248,829 B2 * 7/2007 Kobayashi ..... 399/410
2004/0181309 A1 * 9/2004 Matsumoto et al. ..... 700/223
2004/0213610 A1 * 10/2004 Yuasa ..... 399/401
2005/0082735 A1 4/2005 Nakamura et al. ..... 271/1
2005/0084308 A1 4/2005 Nakamura et al. ..... 399/407
2006/0038337 A1 * 2/2006 Kobayashi ..... 270/58.09
2006/0061032 A1 3/2006 Kamiya et al. ..... 271/221
2006/0279037 A1 12/2006 Kushida et al. ..... 270/58.08

* cited by examiner

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

A bundle discharge roller pair is made to rotate backward in a holding state in which the sheets are held between the bundle discharge roller pair, and, at the same time, the upper bundle discharge roller of the pair is separated from the lower bundle discharge roller of the pair. The released sheets slide down on the inclined processing tray at a return velocity Vb; and are made to run into the rear end stopper for aligning. The return velocity Vb may be controlled according to the reverse-rotational speed of the bundle discharge roller pair and is set at a low velocity, when it is found that, for example, the size of the sheet is large, and the return velocity Vb is increased in the case of coated paper with a large coefficient of friction.

22 Claims, 11 Drawing Sheets

FIG.7

| SIZE | SMALL SIZE (A4,LTR,AND THE LIKE) | | MIDDLE SIZE (A4-R,LTR-R) | | LARGE SIZE (A3,LDR,LGL) | |
|---|---|---|---|---|---|---|
| PAPER KIND | PLAIN PAPER | COATED PAPER | PLAIN PAPER | COATED PAPER | PLAIN PAPER | COATED PAPER |
| Vb | 500 | 600 | 450 | 550 | 400 | 500 |

(a)

(b)

(c)

(a)

(b)

(a)

(b)

SHEET STACKING DEVICE AND SHEET PROCESSING DEVICE, AND IMAGE FORMING APPARATUS PROVIDED THEREWITH

BACKGROUND OF THE INVENTION

1. Field of the Invention

The present invention relates to an image forming apparatus such as a copying machine, a facsimile machine, a printer and a multifunction machine, and, moreover, to a sheet stacking device stacking a sheet (recording medium) formed with an image, and a sheet processing device performing post processing of a sheet.

2. Description of the Related Art

A sheet processing device with the following configuration has been well known as a sheet processing device into which a sheet with an image formed in an image forming apparatus is conveyed. The sheet processing device has a buffer roller through which, when the sheet processing device receives sheets, which have been formed with an image, and have been discharged from an image forming apparatus main body, the received sheets are superimposed for temporary waiting before the sheets are conveyed to a post processing mechanism such as a stapling machine and a saddle stitching machine. That is, while a preceding sheet bundle is processed in a processing tray, first several sheets of the succeeding sheet bundle are on the buffer roller for temporary waiting. When the preceding sheet bundle, which has been processed, is discharged from the processing tray, the succeeding several sheets, which have been delivered from the buffer roller, are conveyed to the processing tray. A brief explanation of a sheet post-processing device with the above-described configuration will be given, referring to FIG. 9A through FIG. 9C.

A plurality of sheets P1, P2, . . . are superimposed one on top of another and wrapped around a buffer roller 5 to form a wrapping path 32. For example, three sheets P1, P2, and P3 are superimposed one on top of another, delivered from the path 32 after temporary waiting, conveyed, and conveyed to a processing tray 101 through a discharge roller 7, bundle discharge rollers 180*a*, and 180*b*. When the rear ends of the sheets pass the discharge roller 7, the bundle discharge rollers 180*a* and 180*b* rotate in the reverse direction in such a way that the sheet bundle of three sheets P1, P2, and P3 is returned in the direction in which the sheets abut against a rear-end stopper 3 of the processing tray 101. Alignment is performed in such a way that the bundle discharge roller 180*b* is separated from the bundle discharge roller 180*a* just before the rear end of the sheet bundle abuts against the rear-end stopper 3 and the sheet bundle abuts against the rear-end stopper 3 by moving inertia. At this time, alignment in a direction perpendicular to the conveyance direction is performed, using aligning plates.

When all the sheets of the first sheet bundle are aligned on the processing tray 101 in such a manner, a swinging guide 150 is lowered and the bundle discharge roller 180*b* sits atop the sheet bundle to perform stitching processing of the sheet bundle, and the like, using a processing machine such as a stapling machine indicated by a reference number 4 in FIG. 9A.

According to the above-described procedures, a first plurality of sheets of the succeeding second sheet bundle are wrapped around the buffer roller 5 as a temporary accumulating unit for waiting until processing for the first sheet bundle is completed. Thereby, a high-speed image forming apparatus by which sheets are discharged from the main body of an image forming apparatus at a small interval may be realized. Incidentally, the varieties of the quality and the size of sheets have been further increased in recent years. But the sheet processing device shown in FIG. 9A through FIG. 9C may hardly treat sheets, for example, special paper such as coated paper, the surface of which is treated, thick one, and large-sized one.

Even if these kinds of sheets may be surely aligned one by one, it is difficult to align a plurality of the sheets in a state in which the sheets are superimposed. That is, the rear ends of a plurality of the sheets with a special quality, or with a special sheet size is run into the rear-end stopper 3 on the processing tray 1. In this case, there is generated a state in which all the three sheets P1, P2, and P3 with a large coefficient of friction, such as that of coated paper, are not completely returned to the rear end of the stopper 3. Especially, it is serious that the sheet P2 such as the second sheet of the superimposed ones is incompletely or faultily returned, that is, the quality of the post processing is deteriorated, and, consequently, the productivity is reduced. Moreover, when a plurality of sheets such as a thick one, and a large-sized one are superimposed and moved, there is caused larger inertia than the one caused in a case in which one sheet is moved. Accordingly, there is a case in which non-aligning is caused, because the sheets are vigorously run into the rear-end stopper 3 and bound. Moreover, there is a possibility that the end portion of the sheet buckles, and is damaged.

SUMMARY OF THE INVENTION

Then, the object of the present invention is to provide a sheet stacking device and a sheet processing device which may adequately align several sheets at post processing even in a case of the sheets with a special quality and specially-sized ones, and which may be applied to an image forming apparatus for a high-speed processing machine to improve the productivity.

An aspect of the present invention, which achieves the above-described object, is a sheet stacking device with the following configuration having: a stacking unit which stacks sheets, a sheet-end regulating member which regulates one end of a sheet which has been stacked on the stacking unit; a moving unit which moves the plurality of sheets, superimposed and conveyed to the stacking unit, to the sheet-end regulating member; and a controller which controls the moving unit in accordance with sheet conditions so as to change the velocity at which said plurality of sheets abut against said sheet-end regulating member.

Moreover, an aspect of the present invention, which achieves the above-described object, is a sheet processing device, having: an image forming part by which an image is formed on a sheet, a stacking unit which stacks sheets; a sheet-end regulating member which regulates one end of a sheet which has been stacked on the stacking unit; a sheet processing unit by which the sheet regulated by the sheet-end regulating member is processed; a moving unit which moves the plurality of sheets, superimposed to the stacking unit, to the sheet-end regulating member; and a controller which controls the moving unit in accordance with sheet conditions so as to change the velocity at which said plurality of sheets abut against said sheet-end regulating member.

BRIEF DESCRIPTION OF THE DRAWINGS

FIG. 7 is a table in which return velocities Vb are listed according to sheet kinds and sheet sizes;

DESCRIPTION OF THE PREFERRED EMBODIMENT

Hereinafter, preferable embodiments of a sheet stacking device and a sheet processing device, and an image forming apparatus provided with the sheet stacking device and the sheet processing device according to the present invention will be explained in detail, referring to drawings.

<Image Forming Apparatus>

Figure 1:
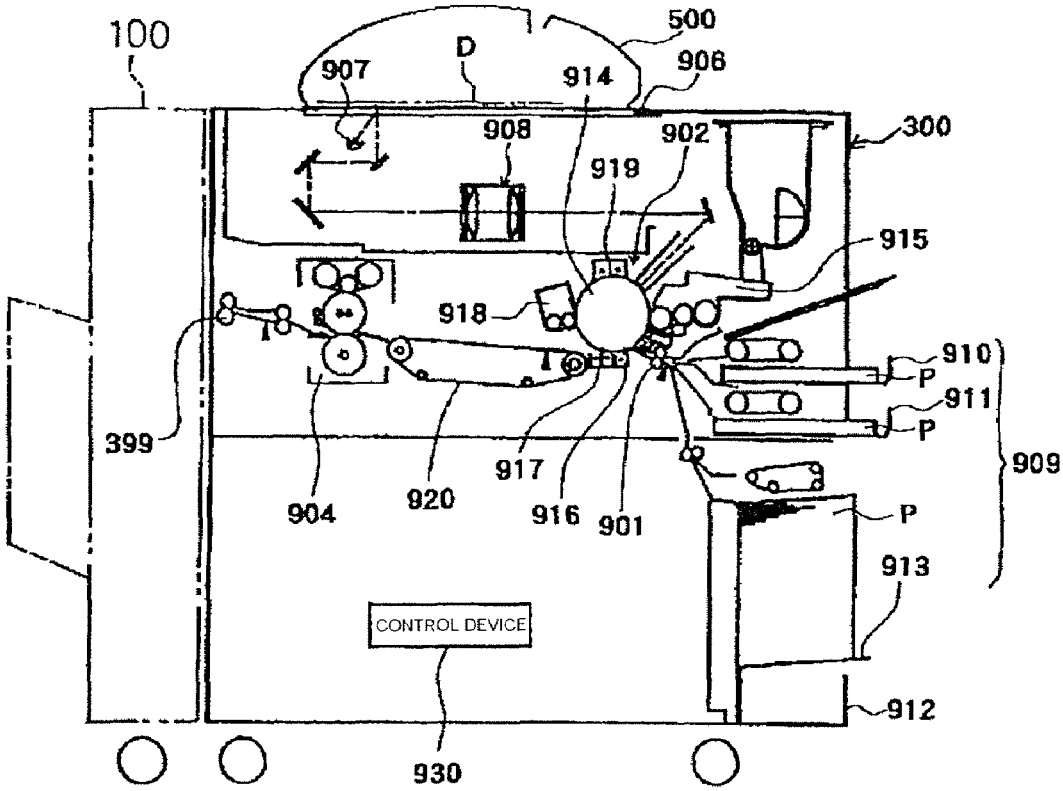
FIG. 1 is a general view showing a sheet post-processing device according to the present embodiment and an image forming apparatus provided therewith.

As shown in FIG. 1, a an image forming apparatus main body 300 has: a platen glass 906 as a original placing base; a light source 907; and a lens system 908, and further includes an automatic original feeding device 500 which feeds a original to the platen glass 906. Moreover, the image forming apparatus main body 300 has a feeding portion 909 through which a sheet P (recording medium) is supplied to an image forming part 902. There is provided with a sheet post-processing device 100 which is coupled to the image forming apparatus main body 300 with the above-described configuration, and which is configured to perform required post processing of a sheet P which is formed with an image, and has been discharged from the image forming part 902.

The feeding portion 909 stacks and stores the sheets P in, for example, upper and lower sheet cassettes 910 and 911 which are put one on top of another, and is installed in a detachable manner in the image forming apparatus main body 300. Moreover, there is provided with a deck 913 arranged in a pedestal 912. The sheets P fed from the sheet cassettes 910 and 911 are conveyed into the image forming part 902. The image forming part 902 has a cylindrical photosensitive drum 914 as an image bearing member, and there are provided around the above drum: a development device 915; a transfer charger 916; a separating charger 917; a cleaner 918; a first charger 919; and the like. Moreover, a conveying device 920, a fixing device 904, a discharge roller pair 905, and the like are arranged downstream of the image forming part 902.

Moreover, the image forming apparatus main body 300 is provided with a control device 930 for integrated control of the whole apparatus, and all devices in all portions are activated according to control signals and activating instruction signals output from the control device 930.

Thus, when a signal instructing a sheet to be fed from the control device 930 is output, feeding of a sheet P from the sheet cassettes 910 and 911, or the deck 913 is started. A original D on the original placing base 906 is exposed to light irradiated from the light source 907, and the photosensitive drum 914 is irradiated with the reflected light through the lens system 908. The photosensitive drum 914 is charged beforehand by the first charger 919, and an electrostatic latent image is formed by light irradiation. Subsequently, the electrostatic latent image is developed by the development device 915 to form a toner image.

Skew feeding of the sheet P fed from the feeding portion 909 is corrected by a registration roller 901, and, furthermore, the sheet P is conveyed to the image forming part 902 in exact timing. In the image forming part 902, the toner image on the photosensitive drum 914 is transferred onto the sheet P by the transfer charger 916, and the sheet P onto which the toner image has been transferred are charged by the separating charger 917 to a state in which the sheet P is opposite in polarity to the transfer charger 916, and is separated from the photosensitive drum 914. The separated sheet P is conveyed to the fixing device 904 by the conveying device 920, and the transferred image is permanently fixed on the sheet P by the fixing device 904. While the sheet P on which the image is fixed is discharged from the image forming apparatus main body 300, using the discharge roller pair, the sheet P is in a direct paper-discharge mode in which the image surface is on the upper side, or in a reversed paper-discharge mode in which, after the image is fixed, the sheet P is conveyed to a sheet reversing path 930 to reverse both the sides, and the image surface is on the lower side. Thus, the image is formed on the sheet P fed from the feeding portion 909, and the sheet P is discharged to the sheet post-processing device 100. Hereinafter, the configuration of the sheet post-processing device 100 will be shown.

<Sheet Stacking Device>

Figure 2:
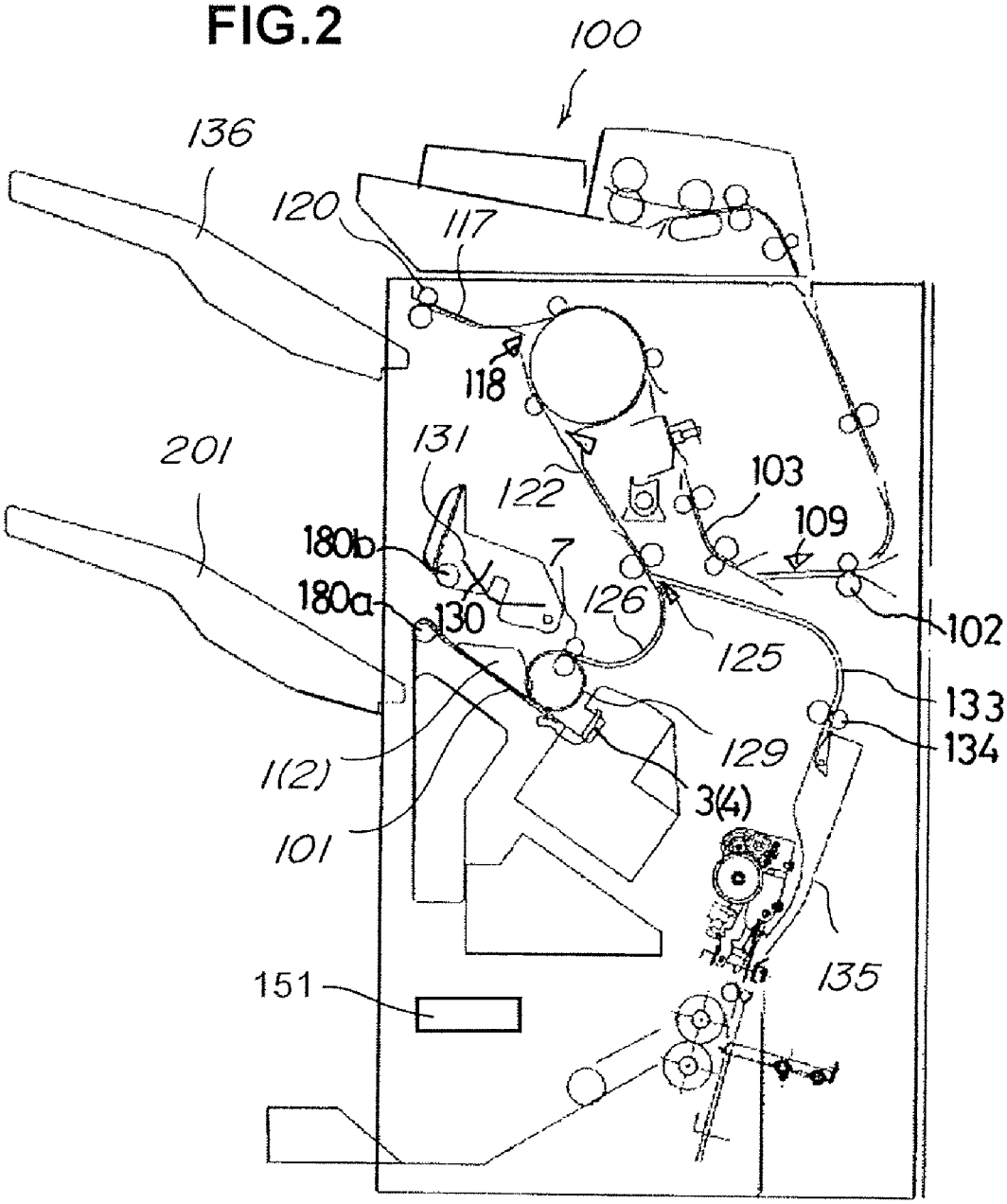
FIG. 2 is a view showing the sheet post-processing device according to the present embodiment.
Figure 3:
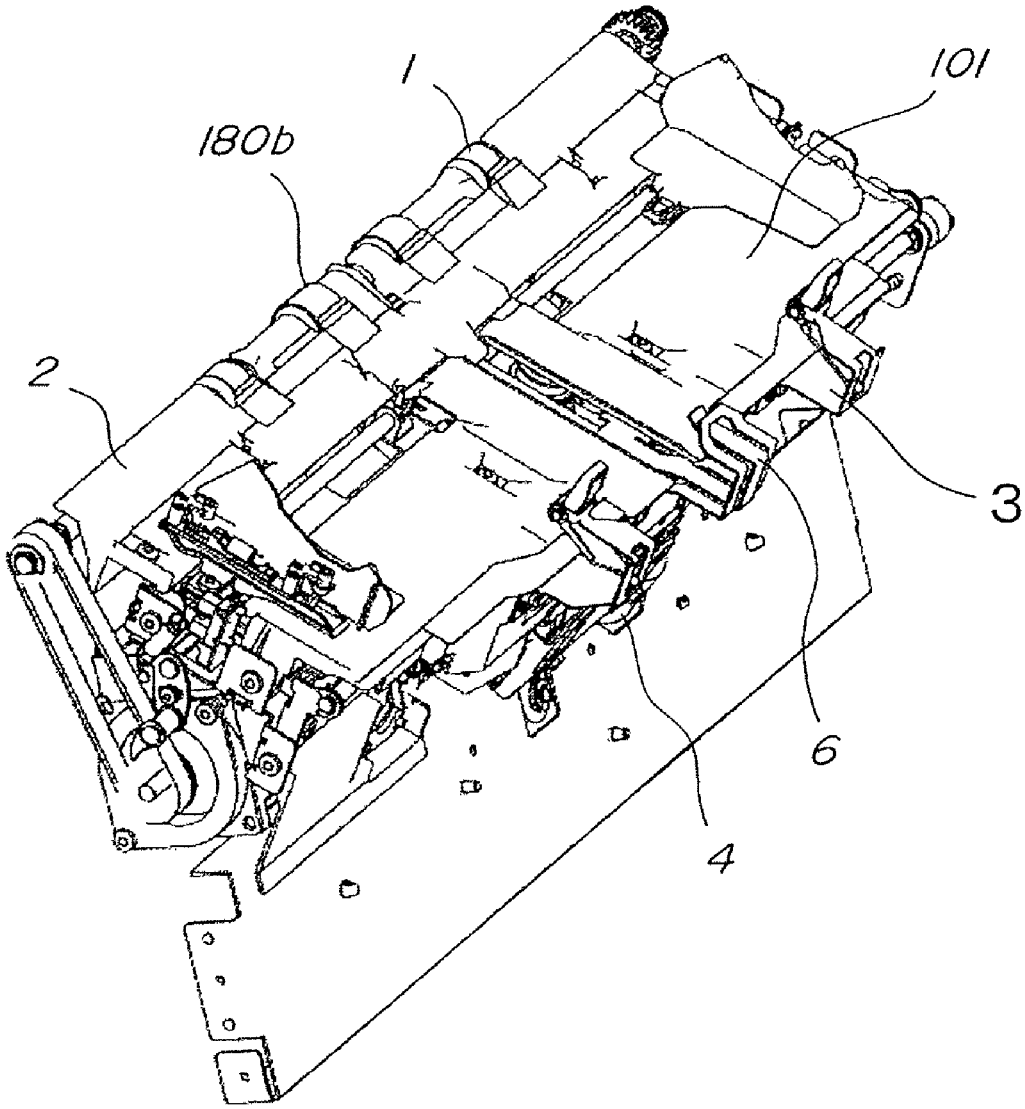
FIG. 3 is a perspective view showing the sheet post-processing device.
Figure 4:
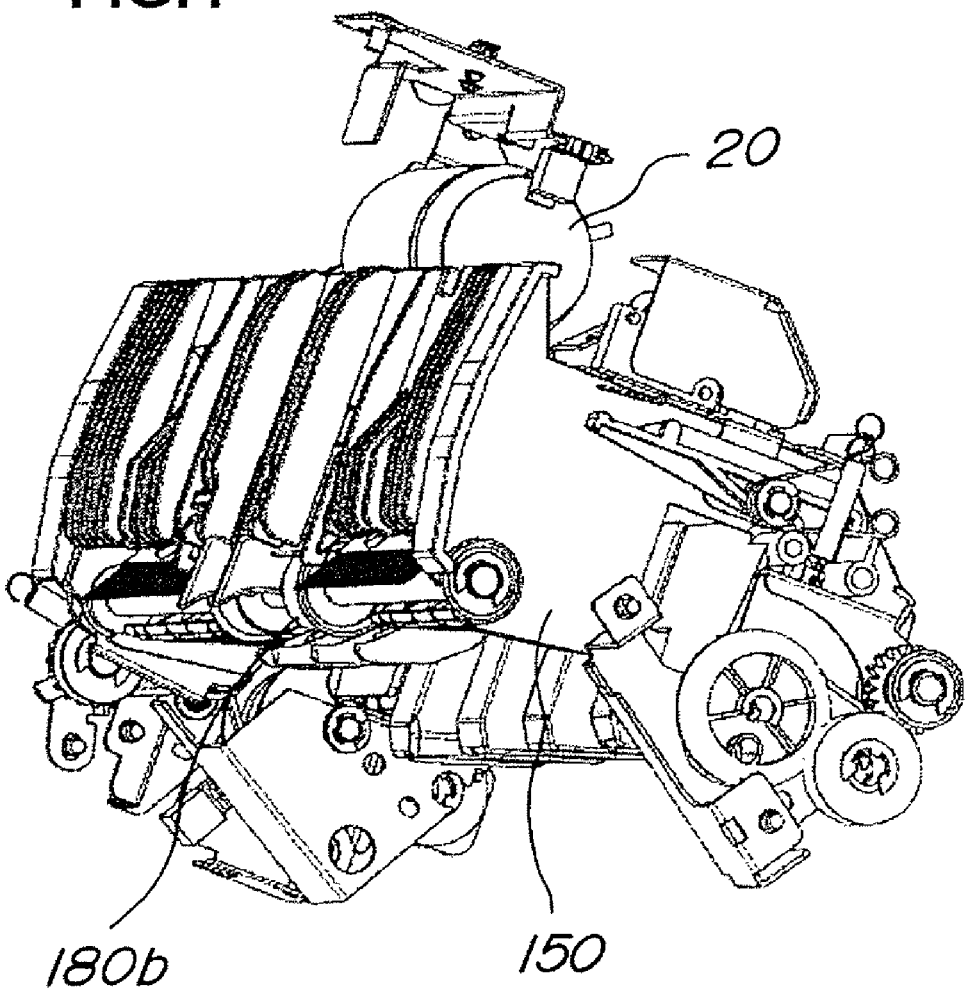
FIG. 4 is a perspective view showing the sheet post-processing device.
Figure 9:
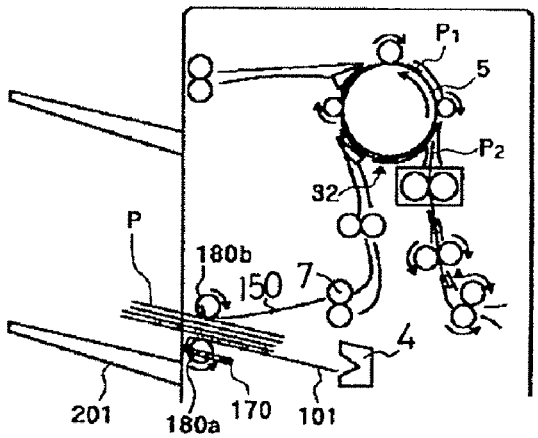
FIGS. 9A to 9C are views showing a conventional aligning form for sheets.
Figure 9:
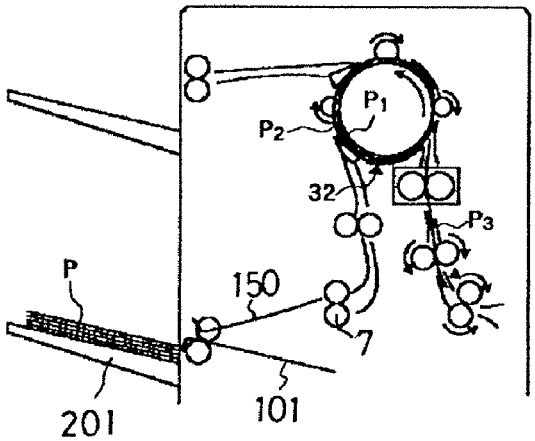
Figure 9:
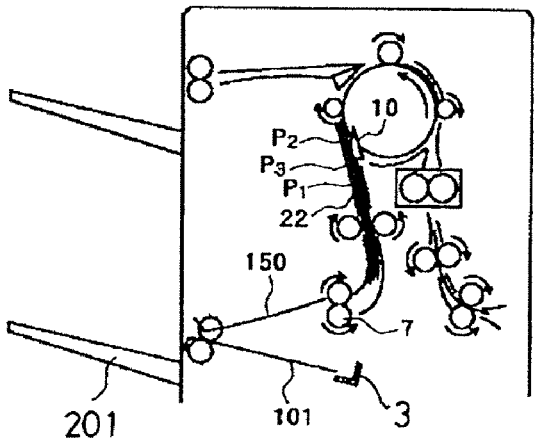

FIG. 2 through FIG. 4 show the sheet post-processing device 100 by which the sheet P formed with an image is received after the sheet P is discharged from the image forming apparatus main body 300, and adequate post processing of the sheet P is performed. Components in the drawings, which are the same as, or similar to those in a conventional example shown in FIG. 9A through FIG. 9C, are denoted by the same reference numbers as those in the example and duplicated explanation will be eliminated.

As shown in FIG. 2, there are provided with a entrance-side roller pair 102 receiving the sheet P formed with an image, and acceptance timing of the sheet P is simultaneously detected by an entrance sensor 109 arranged facing a conveyance path 103 which is located in the neighborhood of the rollers 102. The sheet P is conveyed on the conveyance path 103 through the entrance-side roller pair 102. When the sheet P is discharged to an upper tray (stacking tray) 136, upper-path switching flapper 118 is activated by a driving unit such as a not-shown solenoid. The sheet P is guided to an upper conveyance path 117, and is discharged to the upper tray 136 through a upper discharge roller pair 120.

When the sheet P is not discharged to the upper tray 136, and a plurality of sheets are stacked for adequate post processing, the superimposed plurality of sheets are guided to a stack conveyance path 122 by switching the upper-path switching flapper 118. In the case of, for example, saddle stitching of the sheet P, a saddle-stitching-path switching flapper 125 is activated to convey the sheet P to a saddle stitching path 133, and to guide the sheet P to a saddle stitching unit 135 through a saddle-stitching entrance roller pair 134. Subsequently, the saddle stitching is processed.

On the other side, when the sheet P is discharged to a lower tray 201, the sheet P is conveyed to a lower path 126 by the saddle-stitching-path switching flapper 125. Thereafter, the sheet P discharged to a processing tray 101 as a stacking unit through a lower discharge roller pair 7 is aligned by a returning unit including a paddle 131, a knurling tool belt 129, and the like. At the same time, alignment of the sheet P to the conveyance direction is performed, using a rear-end stopper (sheet-end regulating member) 3 as a aligning unit to the conveyance direction. Alignment to the conveyance direction and the direction perpendicular to the conveyance one is performed by aligning plates 1 and 2 which may be moved in a direction perpendicular to the conveyance direction, is moved by a driving source (not shown), and performs alignment to the width direction of the sheet w. Thereby, alignment of a predetermined number of the sheets P is performed on the processing tray 101. Thereafter, the sheets P are discharged to the lower tray 201 through the bundle discharge roller pair (moving unit) 180*a* and 180*b* after stitching processing of the sheets P by, for example, a stapling machine as a sheet processing unit if required.

Here, a plurality of sheets (a sheet bundle), which have been superimposed after buffer processing which will be described later, are held between the bundle discharge roller pair 180*a* and 180*b*, and, only when the sheets are conveyed toward the rear-end stopper 3, the rotation direction of the rollers 180*a* and 180*b* is reversed to a direction opposite to that at discharge. On the other hand, the returning unit including the paddle 131, the knurling tool belt 129, and the like returns only one sheet (alignment is performed at the rear-end stopper 3), the unit is evacuated to an upper position when a plurality of sheets (a sheet bundle) are returned.

Figure 6:
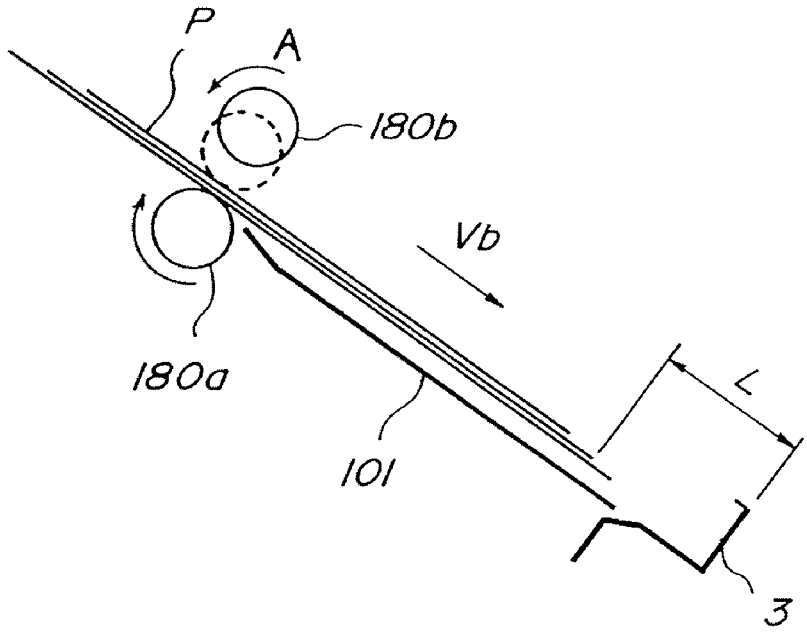
FIGS. 6A and 6B are exemplary views showing two forms of a return velocity at aligning according to the present embodiment.
Figure 6:
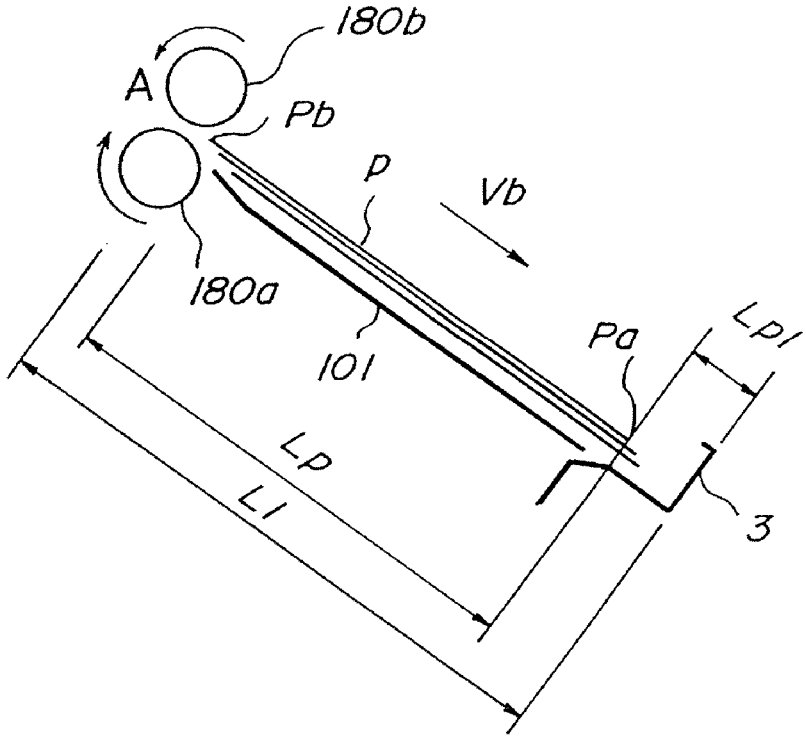

Here, the above-described processing tray 101 inclines downward in the top and bottom direction at an adequate tilt angle from the bundle discharge roller pair 180*a* and 180*b* as the upstream side toward the processing mechanism such as the above-described stapling machine, as shown in FIGS. 6A and 6B which will be described later. The bundle discharge roller pair 180*a* and 180*b* may perform normal-reverse rotation by switching control, and, at normal rotation, a sheet bundle is discharged to the lower tray 201 after stapling processing. On the other hand, the bundle discharge roller pair 180*a* and 180*b* may rotate backward in the A direction of the arrow shown in FIGS. 6A and 6B, and, at the same time, the bundle discharge roller 180*b* at the upper side may be separated from the bundle discharge roller 180*a* at the lower side. Accordingly, the sheet bundle held between the bundle discharge roller pair 180*a* and 180*b* are separated by the above-described procedures. In consequence, the sheet bundle is released from being held therebetween, slide down and go back on the inclined processing tray 101 under their own weights. Then, the rear end of the sheet bundle may abut against the rear end stopper 3 which is waiting for the sheets in the lower part.

Figure 5:
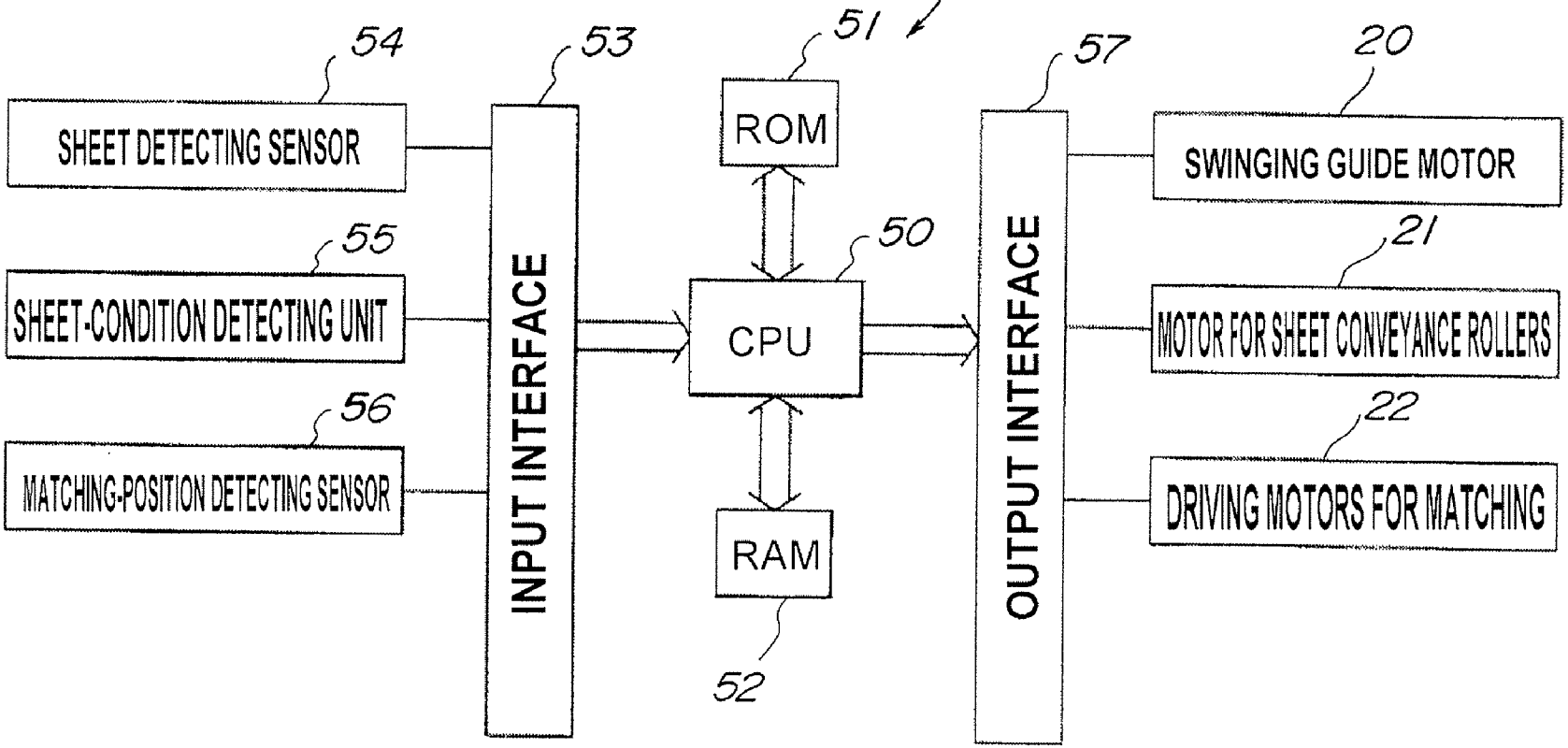
FIG. 5 is a functional block diagram showing the configuration of the sheet post-processing device.

Assuming that the return velocity of the sheet bundle, which slide down on the processing tray 101, is Vb, the return velocity Vb may be controlled by a control device 151 on the side of the sheet post-processing device 100 as a controller shown in FIG. 5 according to conditions such as the quality and the size of the sheet. The first point of the present invention is that, when the sheet bundle runs into the rear-end stopper 3, the velocity of the sheet bundle is controlled by changing at least one of the return velocity Vb of the bundle discharge roller pair 180*a* and 180*b* as a moving unit and the timing of separation which will be described later.

FIG. 5 is a functional block diagram showing the configuration of the sheet post-processing device 100 according to the present embodiment, placing emphasis on the control device 930 on the side of the image forming apparatus main body 300. However, the drawing shows the configuration of only a part related with the control device 151 on the side of the sheet post-processing device 100, and a control signal and an activating signal are transmitted and received between the sheet post-processing device 100 and the control device 930 on the side of the image forming apparatus main body 300.

The control device 151 as a controller includes a microcomputer system, and has a CPU 50, a ROM 51, a RAM 52, and the like. The ROM 51 stores programs for punching, stapling, and the like beforehand. The CPU 50 executes each program to make a predetermined control signal by performing input data processing, while swapping the data with the RAM 52.

The control device 151 has a sheet detecting sensor 54, a aligning-position detecting sensor 56, and a sheet-condition detecting unit 55, and detecting signals from those detecting units are input to the CPU 50 as input data through an input interface circuit 53. Various kinds of control signals are output from the CPU 50 through an output interface circuit 57. The output signals are transmitted to controllers such as a motor driver, and the controllers are controlled to activate a swinging guide motor 20, driving motors 21 for the sheet conveyance rollers 180*a* and 180*b*, driving motors 22 for aligning members 1 and 2, and the like.

Moreover, data is transmitted and received between a main body side CPU provided on the side of the image forming apparatus main body 300 and the above-described CPU 50 for communication. The CPU 50 is configured to obtain various kinds of information on original sizes, numbers of originals, from an automatic original feeder (ADF), to be copied, and the like from the main body side CPU. Furthermore, a user operates an operating panel on the image forming apparatus main body to input sheet information and conditions on sheet kinds (plain paper, coated paper, or special paper), sheet size, and the like, and the CPU 50 may acquire and recognize those sheet conditions. Besides the above-described sheet size, the sheet conditions includes physical properties (surface properties) such as the stiffness, the thickness, the basis weight, the surface resistance, and the smoothness, and sheet kinds such as punched paper, and tab paper. Especially, the surface resistance is influenced by a printed image and humidity. Accordingly, it is also useful to detect the density (amount of sprayed toner) of an image printed on paper, and the humidity, and to add the detected values to the sheet conditions. Generally, the more amount of sprayed toner causes the surface resistance to become relatively smaller. Moreover, the higher humidity environment causes the surface resistance to become larger. Here, the CPU 50 may be provided in the sheet post-processing device 100. Thereby, when the sheet post-processing device 100 is not installed as an option, the cost may be suppressed because only the main body side CPU is required to be provided. Obviously, the control device 930 on the side of the image forming apparatus main body 300 may equally control as a controller the sheet post-processing device 100 directly, or through the control device 151 on the side of the sheet post-processing device 100.

Usually, a time-base, and a distance-base intervals are required between the preceding sheet bundle and the succeeding sheet bundle in order to perform post-processing such as stapling, and saddle stitching in the sheet post-processing device 100. Though the intervals depends on the image forming velocity of the image forming apparatus main body 300 in some cases, it is general that the intervals are longer than usual sheet intervals. Buffer processing (temporary accumulating standby) is executed in order to perform the sheet post processing without interrupting image formation in the image forming apparatus main body 300.

Buffer processing of sheets in the device according to the present invention will be explained.

Buffering operation of sheets is performed in the same manner as that of a conventional sheet processing device, for example, the device shown in FIGS. 9A to 9C in which there is usually provided with the path 32 for buffering, a plurality of sheets is able to be superimposed on the path by the buffer roller 5, and sheets are wrapped around the buffer roller 5 under, for example, a condition that the previous sheet bundle are processed in the processing tray 101.

Figure 11:
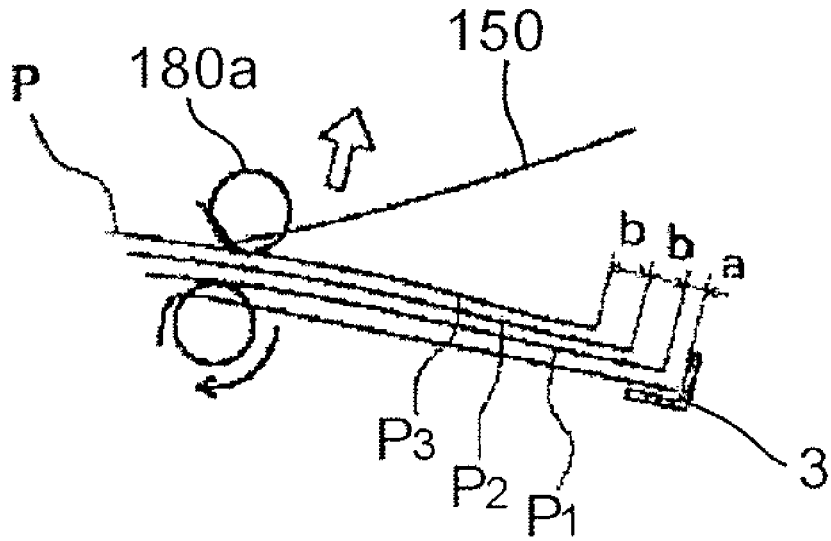
FIGS. 11A and 11B are views showing buffer and discharge operations for sheets.
Figure 11:
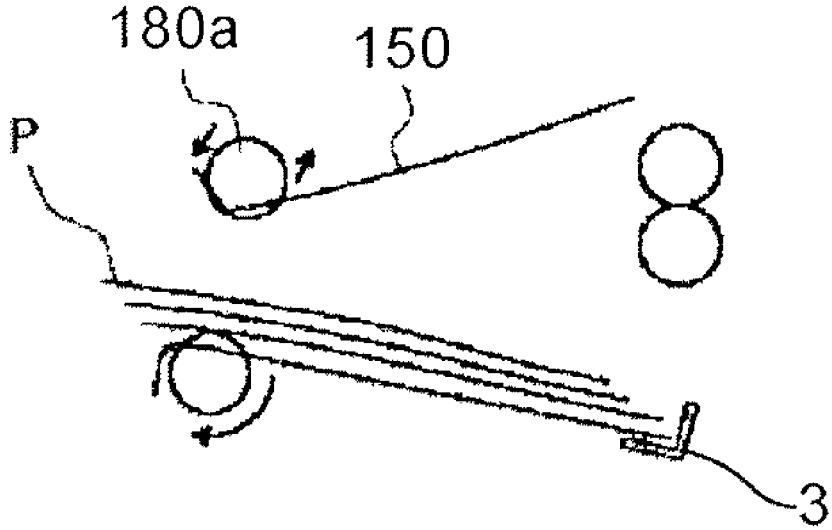

More specifically, when all the sheets of the first bundle are discharged onto the processing tray 101 and are aligned, the swinging guide 150 is lowered, the roller 180*b* sits on the sheet bundle, and the sheet bundle are stapled by a stapling machine 132 as shown in FIG. 4 and FIGS. 11*a* and 11*b*.

In the meantime, the sheet P1 which has been discharged from the image forming apparatus main body 300 is wrapped around the buffer roller 5 by turning the flapper, and the sheets stop after a predetermined distance is covered as shown in FIG. 9A. After the succeeding sheet P2 advances after a predetermined distance is covered from the paper detection sensor 109, the buffer roller 5 rotates as shown in FIG. 9B to superimpose the first sheet P1 and the second sheet P2, and the sheets are wrapped around the buffer roller 5 and stop after a predetermined distance is covered. On the other hand, the sheet bundle on the processing tray 101 is discharged as one bundle onto the stack tray 201 by the rollers 180*a* and 180*b*.

When the third sheet P3 reaches a predetermined position as shown in FIG. 9B, the buffer roller 5 rotates to superimpose the sheet P3, and the flapper is switched to convey three sheets P to the conveyance path 122.

Figure 10:
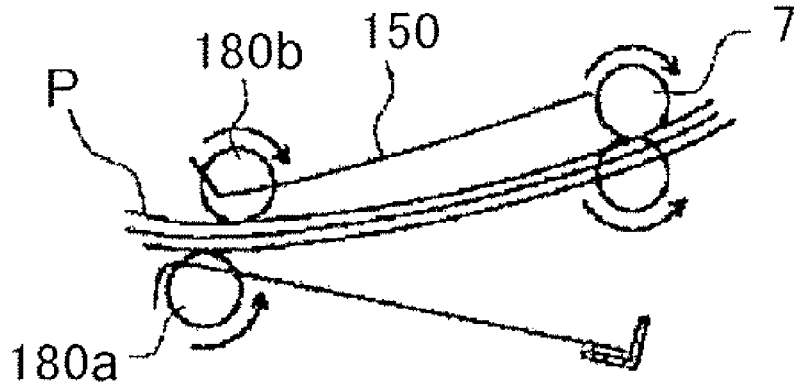
FIGS. 10A and 10B are view showing buffer and discharge operations for sheets.
Figure 10:
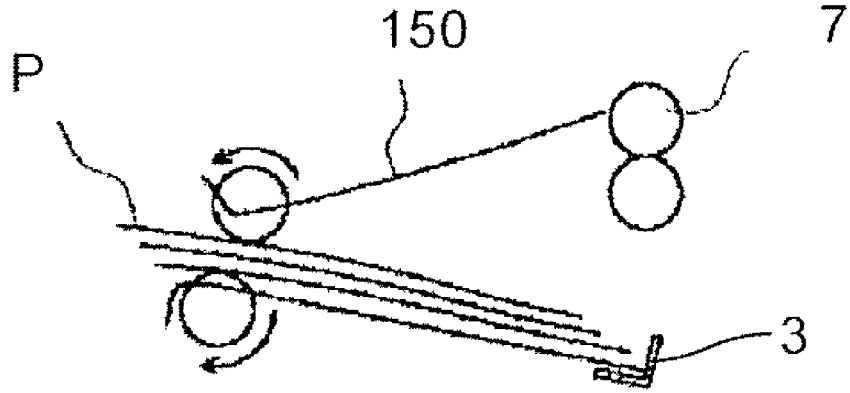

While the swinging guide 150 is lowered as shown in FIG. 10A, three sheets P are received by the rollers 180*a* and 180*b*. Then, when the rear end of the sheet P is off the roller 7 as shown in FIG. 10B, the rollers 180*a* and 180*b* rotate in the reverse direction. Subsequently, the swinging guide 150 is raised as shown in FIG. 11A before the rear end applies against the stopper 3. Thereby, the roller 180*b* separates from the surface of the sheet as shown in FIG. 11B. Then, alignment of the sheet bundle to the rear-end regulating member 3 is performed. Thereafter, alignment in a direction perpendicular to the conveyance direction is performed by the aligning plate. The fourth sheet P or later is discharged onto the processing tray through the same path as that of the first bundle. Subsequently, predetermined processing is performed. The third bundle or later is operated in the same manner as that of the second bundle, and a set number of bundles of sheets are stacked onto the stack tray 201 to complete the operation.

Subsequently, characteristics at superimposing the above-described plurality of sheets P1, P2, and P3 will be described.

As seen from FIGS. 11A and 11B, the sheets P1, P2, and P3 to be superimposed under a state in which the sheets are shifted from one another by a predetermined amount of b in the conveyance direction.

The reason is that a sheet at an upper position is prevented from passing a sheet thereunder or therebelow, and, though the uppermost sheet (P3 in the drawing) may be returned, using another return unit (for example, the knurling tool belt 129 shown in FIG. 2), a sheet thereunder or therebelow may not be returned. Accordingly, the sheets are configured to be shifted form one another as described in the present example.

However, the above-described configuration may be applied except when superimposing accuracy may be secured enough. Moreover, the shift amounts between the sheets are not required to be the same.

FIG. 6A shows a schematic view of aligning operation of the sheet P on the processing tray 101 in cooperation with the above-described buffer processing. The bundle of a plurality of sheets, which have been shifted from one another, are returned onto the processing tray 101 by reverse rotation and separating operation of the bundle discharge roller pair 180*a* and 180*b*, and are made to run into the rear-end stopper 3 for aligning. That is, several sheets P, which have been shifted from one another accumulated one on top of another, are held between the bundle discharge roller pair 180*a* and 180*b*. The bundle discharge roller pair 180*a* and 180*b* are made to rotate backward in the A direction of the arrow shown in the drawing in the above-described holding state, and, at the same time, the bundle discharge roller 180*b* at the upper side is separated from the bundle discharge roller 180*a* at the lower side before the rear ends of the several sheets reach the rear-end stopper 3. According to the present configuration, the bundle of sheets P are released from being held therebetween by the above-described operation; slide down on the inclined processing tray 101 at a return velocity Vb in a direction toward the right side in the drawing; and, then, are made to run into the rear end stopper 3, which is waiting for the sheets in the lower part, for aligning.

Typical sheet (paper) sizes and sheet kinds such as coated paper are used as examples of information on the sheet P, and the return velocities Vb to the rear-end stopper 3 by the bundle discharge rollers 180*a* and 180*b* are summarized and shown in a table of FIG. 7 for each of the sheet kinds and for each of the sheet sizes. As seen from the table, return velocities Vb are set at a low velocity when sheets with a large size and a heavy weight are superimposed, because larger inertial force is caused; and return velocities Vb are increased in the case of coated paper with a large coefficient of friction. When a large number of sheets are superimposed in the case of thick paper, the return velocities Vb may be set at a low velocity because the weight is increased. Moreover, even when small-sized paper, or thin paper is moved, the return velocities Vb for equal to or more than a predetermined number of sheets are required to be set at a low velocity in the case of a device in which the number of superimposed sheets may be changed.

Thus, when the sheet P is made to run into the rear-end stopper 3, there is an open state in which there is caused a distance indicated by a symbol L in FIG. 6A between the rear end of the sheet P and the rear-end stopper 3. In the above-described state, the bundle discharge roller 180*b* at the upper side is moved upward together with the swinging guide 150 (refer to FIG. 4 and FIGS. 9A to 9C) for separation. Control of the separation is performed by control signals from the control device 930. That is, the upper bundle discharge roller 180*b* is separated from the lower bundle discharge roller 180*a* to release the sheet P. The sheet P slides down on the inclined surface of the processing tray 101 under its own weight, that is, is returned to the rear end stopper 3 by the inertial moving energy (inertial force) of the sheet P. Inertial force (W) of the sheet P which runs into the rear-end stopper 3 may be calculated by the following formula.

$$W=\tfrac{1}{2}M\,Vb2-\mu XK-T \qquad (1)$$

Where M in the formula indicates the mass of the sheet P (paper and the like); μX represents the coefficient of friction for the sheet P; K is a coefficient; and T expresses a correction factor.

It is found from the above-described formula (1) that the inertial force W is influenced by the mass M, the return velocity Vb, and the coefficient of friction μX of the sheet. Moreover, when the inertial force W of the sheet P which runs into the rear-end stopper 3 is beyond the predetermined limits, faulty returning is generated to cause non-aligning. That is, when the inertial force W is larger than a predetermined value, non-aligning is generated by bounding of the sheet P which has run into the rear-end regulating member. Moreover, when the inertial force W is smaller than the predetermined value, non-aligning is generated by faulty returning.

Accordingly, even if the sheet kind is different, it is important that the inertial force W is invariable, and a predetermined constant value, and the following formula is required to hold.

$$WNL \approx WNS \approx WCS \quad (2)$$

Where WNL in the formula indicates the kinetic energy of large-sized plain paper; WNS represents the kinetic energy of small-sized plain paper; and WCS indicates the kinetic energy of small-sized coated paper.

As it is found from the above-described formula (1) that values of the mass M and the coefficient of friction μX are decided mainly by the sheet kind, the inertial force W may be set at a constant value by changing the return velocity Vb. The table FIG. 7 shows one example in which velocities Vb are decided, based on the above conditions.

Figure 8:
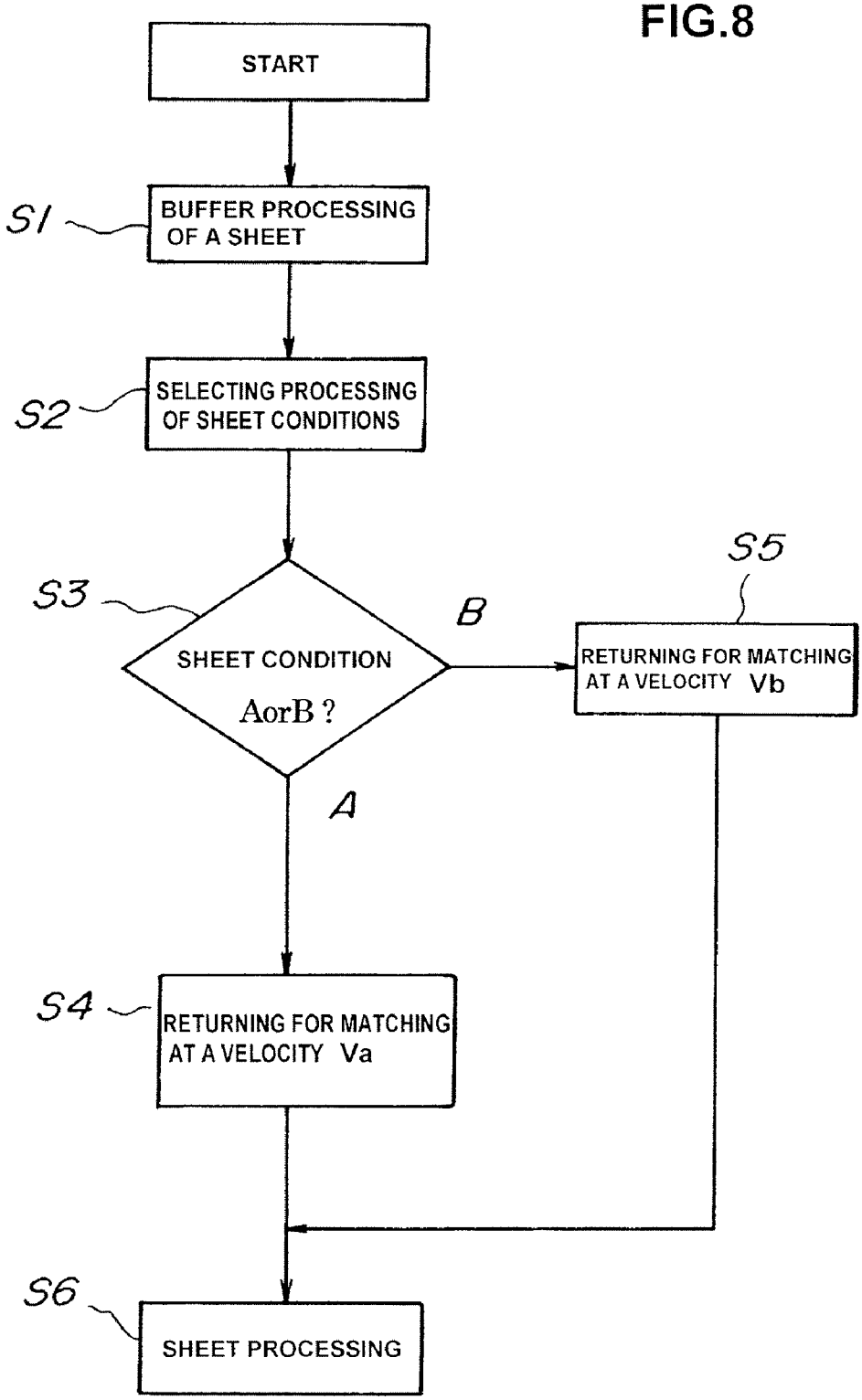
FIG. 8 is a flowchart showing an operation example according to the present embodiment.

As described above, in the sheet post-processing device 100 according to the present embodiment, the return velocity Vb, which is used when the sheet P is aligned on the processing tray 101, is changed according to detected conditions of the sheet P, or based on information on sheet conditions acquired from the image forming apparatus main body 300. That is, the sheet P is aligned by controlling the reverse-rotational speed of the bundle discharge roller pair 180*a* and 180*b* to change the return velocity Vb of the sheet P returning in a direction in which the sheet P runs into the rear-end stopper 3. Steps from STEP S1 to STEP S6 in an operation flowchart of FIG. 8 represents an example in which the return velocity Vb is controlled based on the above-described sheet conditions.

As described above, though a case in which the number of sheets P superimposed at moving is three has been illustrated in the present embodiment, it is obvious that the number of sheets is only one case, and even another case in which the number of sheets is two, or four or more is effective. Here, though the present explanation has been made, assuming that the number of superimposed sheets is constant, the moving velocity may be controlled, depending not on the sizes of sheets, but on the number of sheets in the case of a device in which the number of superimposed sheets is configured to be changed. Moreover, the shift amount of the sheet P depends on the processing ability of the image forming apparatus main body 300, and the size of the apparatus, and the shift amount L has been set as about 2 mm to about 10 mm in the present embodiment. But, other values may be applied to the amount.

Subsequently, a case in which the return velocity Vb is controlled according to the timing of separation of the bundle discharge roller 180*b* from the bundle discharge roller 180*a* as a moving unit will be explained, using FIG. 6B. The timing in which the swinging guide 150 is raised depends on processing performances of the image forming apparatus main body 300 and the sheet post-processing device 100. In the present embodiment, the return velocity based on the reverse-rotational speed of the bundle discharge roller pair 180*a* and 180*b* is set as, for example, at 500 mm/s for plain paper. Moreover, the timing of separation of the bundle discharge roller 180*b* at the upper side from the bundle discharge roller 180*a* at the lower side is set as a point at which the sheet P1 reaches a location about 40 mm (value of L) before a location at which the sheet P applies against the rear-end stopper 3. Furthermore, while the sheet P is returned by the bundle discharge roller pair 180*a* and 180*b*, and while the end of the sheet reaches and applies against the rear-end stopper 3, influence of external force, by which further another stack is applied to the inertial force W, is required to be removed. That is, extra force is configured to be prevented from applying the inertial force W before several superimposed sheets P slide down on the inclined surface of the processing tray 101 only by the inertia force W, and is aligned by the rear-end stopper 3. Considering the above-described circumstances, it is preferable to locate the return unit (the paddle 131, and the knurling tool belt 129) at a position, at which the unit does not abut against the sheet P, for separation. But another configuration may be applied.

On the other hand, FIG. 6B is a schematic view showing an embodiment for aligning, in which the length Lp of the sheet is shorter than a distance L1 between the bundle discharge roller pair 180*a* and 180*b* and the rear-end stopper 3.

A distance Lp1 between the opposite end Pa of the sheet and the rear-end regulating member 3 depends on the size of the sheet at the moment when the end Pb of the sheet separates from the bundle discharge roller pair 180*a* and 180*b*. The inertial force W in the above drawing FIG. 6A is influenced by the inclined angle, the surface material, and the like of the processing tray 101, and is also changed according to the length of the distance Lp1.

That is, the configuration of FIG. 6B has an advantage that the velocity at which the accumulated sheets Pare discharged is changed according to the distance Lp1 between the sheet end and the rear-end stopper 3, or the size of the sheet (sheet length in the conveyance direction). Moreover, when the above-described short sheet is discharged to the stack tray, the sheet P is conveyed by a sheet extruding member 6 shown in FIG. 3 at least to a position at which the sheet P reaches the bundle discharge roller pair I80*a* and 180*b*.

As seen from the above-described two forms shown in FIGS. 6A and 6B illustrating sheet aligning states respectively, the control device 151 as a controller controls the reverse-rotational speed of the bundle discharge roller pair 180*a* and 180*b* to change the return velocity Vb corresponding to sheet conditions such as the quality and the size of the sheet P. At the same time, timing in releasing the bundle of the sheets P is controlled by separating the bundle discharge roller 180*b* at the upper side. Here, energy by which sheets abut against the rear-end stopper 3 may be similarly changed even by changing only timing in releasing the bundle of sheets P by separating the bundle discharge roller 180*b* at the upper side in correspondence to sheet conditions such as the quality and the size of the sheet P. Accordingly, similar effects are obtained. Moreover, only control of the reverse-rotational speed of the bundle discharge roller pair 180*a* and 180*b* is required in some cases. However, in order to realize a reliable aligned state, it is more preferable to perform the above two control method. Thereby, there are no sheets which do not finish returning in a state in which a plurality of sheets P are superimposed, not depending on the quality and the size of the sheets, and all the bundle of sheets P adequately run into the rear-end stopper 3 for aligning. Accordingly, adequate and rapid alignment of sheets realized in the above-described sheet post-processing device 100 contributes in a comprehensive manner to the maintenance or improvement of the productivity in the high-speed processing image forming apparatus main body 300. Control through the control device 151 on the side of the sheet post-processing device 100 has been explained in the above-described embodiment, wherein at least one of the return velocity Vb of the bundle discharge roller pair 180*a* and 180*b* and the timing of separation is changed by the above control. But direct control from the control device 930 on the side of the image forming apparatus main body 300 may be applied.

Here, the present invention is not limited to the above-described embodiment, and other embodiments, applications, variants, and those combinations may be possible without departing from the scope of the present invention.

This application claims the benefit of priority from the prior Japanese Patent Application No. 2005-251424 filed on Aug. 31, 2005 the entire contents of which are incorporated by reference herein.

What is claimed is:

1. A sheet stacking apparatus comprising:

a stacking unit on which sheets are stacked;

a superimposing unit capable of superimposing sheets to be conveyed to said stacking unit;

a sheet-end regulating member against which a sheet, conveyed to said stacking unit, is abutted to regulate one end of the sheet;

a moving unit capable of moving a plurality of sheets, superimposed on said superimposing unit and conveyed to said stacking unit, to said sheet-end regulating member; and a controller which controls said moving unit in accordance with sheet information so as to change a velocity at which the plurality of sheets abut against said sheet-end regulating member.

2. The sheet stacking apparatus according to claim 1, wherein said moving unit has a roller pair which nips and moves the plurality of sheets, one of said roller pair may be separated from the other roller before the plurality of sheets abut against said sheet-end regulating member, and said controller changes the velocity at which the plurality of sheets abut against said sheet-end regulating member by changing at least one of the rotational speed of said roller pair and timing in which one of said roller pair separates from the other roller.

3. The sheet stacking apparatus according to claim 1, wherein one of said sheet information is the surface properties of a sheet, and a moving velocity is configured to be increased when said surface properties make a coefficient of friction large.

4. The sheet stacking apparatus according to claim 1, wherein one of said sheet information is the weight of a sheet, and the larger weight causes the moving velocity to become smaller.

5. The sheet stacking apparatus according to claim 1, wherein one of said sheet information is the size of a sheet, and the larger size causes the moving velocity to become smaller.

6. The sheet stacking apparatus according to claim 1, wherein one of said sheet information is the stiffness of a sheet, and the higher stiffness causes the moving velocity to become smaller.

7. The sheet stacking apparatus according to claim 1, wherein one of said sheet information is the thickness of a sheet, and the larger thickness causes the moving velocity to become smaller.

8. A sheet processing apparatus, having:

a stacking unit on which sheets are stacked;

a superimposing unit capable of superimposing sheets to be conveyed to said stacking unit;

a sheet-end regulating member against which a sheet, conveyed to said stacking unit, is abutted to regulate one end of the sheet;

a sheet processing unit which processes a sheet regulated by said sheet-end regulating member;

a moving unit capable of moving a plurality of sheets, superimposed on said superimposing unit and conveyed to said stacking unit, to said sheet-end regulating member; and a controller which controls said moving unit in accordance with sheet information so as to change a velocity at which the plurality of sheets abut against said sheet-end regulating member.

9. The sheet processing apparatus according to claim 8, wherein said moving unit has a roller pair which nips and moves the plurality of sheets, one of said roller pair may be separated from the other roller before the plurality of sheets abut against said sheet-end regulating member, and said controller changes the velocity at which the plurality of sheets abut against said sheet-end regulating member by changing at least one of the rotational speed of said roller pair and timing in which one of said roller pair separates from the other roller.

10. An image forming apparatus, having:

an image forming part by which an image is formed on a sheet; and the sheet processing apparatus according to claim 8, which processes a sheet formed with an image.

11. The sheet processing apparatus according to claim 8, wherein one of said sheet information is the surface properties of a sheet, and a moving velocity is configured to be increased when said surface properties make a coefficient of friction large.

12. The sheet processing apparatus according to claim 8, wherein one of said sheet information is the weight of a sheet, and the larger weight causes the moving velocity to become smaller.

13. The sheet processing apparatus according to claim 8, wherein one of said sheet information is the size of a sheet, and the larger size causes the moving velocity to become smaller.

14. The sheet processing apparatus according to claim 8, wherein one of said sheet information is the stiffness of a sheet, and the higher stiffness causes the moving velocity to become smaller.

15. The sheet processing apparatus according to claim 8, wherein one of said sheet information is the thickness of a sheet, and the larger thickness causes the moving velocity to become smaller.

16. An image forming apparatus, having:

an image forming part by which an image is formed on a sheet;

a stacking unit on which sheets formed with an image are stacked;

a superimposing unit capable of superimposing sheets to be conveyed to said stacking unit;

a sheet-end regulating member against which a sheet, conveyed to said stacking unit, is abutted to regulate one end of the sheet;

a moving unit capable of moving a plurality of sheets, superimposed on said superimposing unit and conveyed to said stacking unit, to said sheet-end regulating member; and a controller which controls said moving unit in accordance with sheet information so as to change a velocity at which the plurality of sheets abut against said sheet-end regulating member.

17. The image forming apparatus according to claim 16, wherein said moving unit has a roller pair which nips and move the plurality of sheets, one of said roller pair may be separated from the other roller before the plurality of sheets abut against said sheet-end regulating member, and said controller changes the velocity at which the plurality of sheets abut against said sheet-end regulating member by changing at least one of the rotational speed of said roller pair and timing in which one of said roller pair separates from the other roller.

18. The image forming apparatus according to claim 16, wherein one of said sheet information is the surface properties of a sheet, and a moving velocity is configured to be increased when said surface properties make a coefficient of friction large.

19. The image forming apparatus according to claim 16, wherein one of said sheet information is the weight of a sheet, and the larger weight causes the moving velocity to become smaller.

20. The image forming apparatus according to claim 16, wherein one of said sheet information is the size of a sheet, and the larger size causes the moving velocity to become smaller.

21. The image forming apparatus according to claim 16, wherein one of said sheet information is the stiffness of a sheet, and the higher stiffness causes the moving velocity to become smaller.

22. The image forming apparatus according to claim 16, wherein one of said sheet information is the thickness of a sheet, and the larger thickness causes the moving velocity to become smaller.

* * * * *